United States Patent [19]

Sherman

[11] 3,997,049

[45] Dec. 14, 1976

[54] ENCLOSURE FOR HARD AND SOFT CONTACT LENSES

[75] Inventor: Guy J. Sherman, Sarasota, Fla.

[73] Assignee: Milton Roy Company, St. Petersburg, Fla.

[22] Filed: Sept. 4, 1975

[21] Appl. No.: 610,226

[52] U.S. Cl. ..... 206/5.1; 137/143; 206/459; 220/23

[51] Int. Cl.[2] ..... A45C 11/04; B65D 85/54

[58] Field of Search ..... 134/117, 137, 143, 166 R, 134/201; 206/501, 205, 210, 459; 220/23

[56] References Cited

UNITED STATES PATENTS

| | | | |
|---|---|---|---|
| 2,609,828 | 9/1952 | Ward | 134/166 R X |
| 3,343,657 | 9/1967 | Speshyock | 206/501 |
| 3,444,868 | 5/1969 | Hungerford et al. | 206/501 X |
| 3,460,552 | 8/1969 | Sturgeon | 206/501 X |
| 3,643,672 | 2/1972 | Brown | 134/143 |
| 3,770,113 | 11/1973 | Thomas | 134/143 X |
| 3,856,571 | 12/1974 | Sherman | 134/137 X |

*Primary Examiner*—Steven E. Lipman
*Attorney, Agent, or Firm*—Woodcock Washburn Kurtz & Mackiewicz

[57] ABSTRACT

An improved container for storing and conditioning both hard and soft contact lenses. A pair of lens-retaining baskets are pivotally mounted within the cap of a fluid-tight container. With the cap removed and inverted, the baskets may be folded outwardly to allow unimpaired access to the lenses therein. The basket lids open in a common direction, providing immediate identification of right and left lens baskets.

13 Claims, 3 Drawing Figures

ENCLOSURE FOR HARD AND SOFT CONTACT LENSES

BACKGROUND OF THE INVENTION

The present invention relates to containers for contact lenses, and more particularly to containers for facilitating the soaking, asepticizing and rinsing of lenses of both the hard and soft types.

With the advent of contact lenses, there arose a need for compact, economical enclosures in which to store and condition the lenses. In the case of the so-called "hard" contact lens, it was necessary to provide a fluid-holding container into which the lenses could be placed and submerged. The immersion fluid serves several purposes, acting as a cleaner and an asepticizing agent for preventing the growth of undesirable organisms on the lens surface.

With the newer "soft" lenses, a somewhat different regimen is required. The so-called "soft" lenses are of porous nature, and must be hydrated in order to maintain their pliable quality. In addition, however, the porous nature of the lens material makes the lenses more susceptible to the harboring of micro-organisms. Thus, sterilization of the lenses is even more critical than with hard lenses. Typically soft lenses are kept immersed in a saline solution and asepticized by heating. In particular, the lenses are usually either steamed or boiled in the saline solution.

It will therefore be seen that contact lens cases must withstand the aseptization procedure for the lenses, in addition to comprising a safe and rugged repository for the lenses when not in use. However, due to the substantial difference in size between the so-called "hard" and "soft"contact lenses, and due to the great difference in the sterilization regimens to date no completely satisfactory containers have been developed for use with both the hard and soft varieties of contact lenses.

Of the various types of contact lens containers which have been developed so far, most present considerable difficulty to the user in manipulating the contact lens basket and withdrawing the lenses therefrom. Some schemes use separate cases and lens baskets, in which case the baskets can be misplaced after being withdrawn from the outer case.

Another difficulty which lens case manufacturers have sought to overcome is the opportunity for inadvertently interchanging right and left lenses. For this reason, most commerically available baskets are provided with visible indicia such as the letters R and L. Since the baskets are normally immersed in fluid it is undesirable to form the identifying letters from different material, of contrasting color, since particles of the applied material can become dislodged and find their way to the surface of the lenses. Accordingly, the indicia are generally formed either in relief or as raised surfaces. While this identification may be adequate under good ambient lighting conditions for individuals with relatively good vision, the unaided vision of many contact lens wearers is extremely poor and even differently colored lens baskets may not be distinguished. For this reason, after they have removed the contact lenses it is impossible for many wearers to be able to distinguish one lens receptacle from the other. Of course, only rarely is an individual capable of recognizing the lettered indicia formed on the containers through his sense of touch. Accordingly, it will be understood that there exists a need for an easily manipulable contact lens container which provides improved access to lens baskets for inserting and withdrawing the lenses, and which requires only a minimal amount of conditioning solution. It will also be appreciated that it would be highly desirable for a contact lens container to be constructed such that the proper retainers for right and left lenses could be instantly determined, without the need for identifying indicia.

It is therefore an object of the present invention to provide a contact lens container which is usable with either hard or soft contact lenses.

It is another object of the invention to provide a contact lens case which requires a minimal amount of conditioning solution.

Still another object of the invention is to produce a contact lens container providing easy removal of lenses therefrom.

Another object of the invention is to provide means for retaining a pair of contact lenses which allows receptacles for right and left lenses to be immediately determined without the need for visible indicia.

A further object is to furnish a contact lens container which allows lenses to be easily placed therein and removed therefrom, without manipulating a separable enclosure or basket.

Yet another object is to provide an improved contact lens container which facilitates the rinsing of the lenses by either boiling or by immersion in a stream of water.

SUMMARY OF THE INVENTION

Briefly stated, in accordance with one aspect of the invention the foregoing objects are achieved by providing a fluid-tight enclosure comprising a cannister and a threaded cap. Within the cap, and hinged thereto, are a pair of basket-like foraminous lens receptacles. Each receptacle comprises a cupped body with a lid pivotally attached thereto. The hinge mounting allows the retainers to be folded inwardly to confront one another before being inserted within the cannister. With the cap removed from the cannister the lens receptacles can be folded apart. The lid pivot points are oriented on a common side of the receptacle-supporting hinges so that the lids open in a predetermined direction when the left and right lens receptacles are properly oriented with respect to the user.

In one embodiment of the invention, the cannister is cylindrical in form and has a spherical end portion closely conforming to the curvature of the juxtaposed lens retainers. Further, one of the lens receptacles is provided with a protrusion for tactile identification. The container is formed of materials which withstand both asepticizing solution and high temperatures, thus accommodating both soft and hard lenses.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
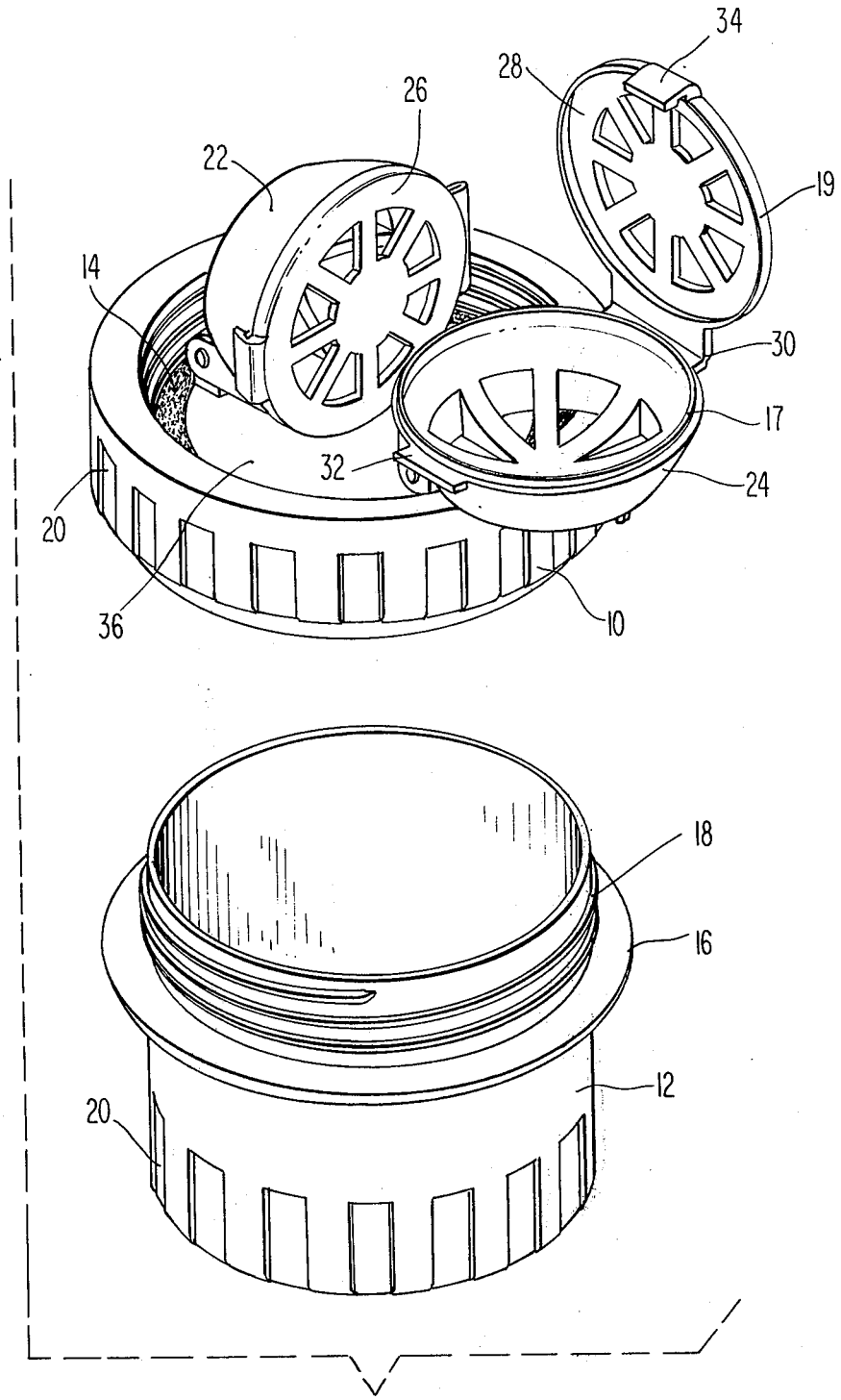
FIG. 1 is a prospective drawing of one form of a contact lens container constructed in accordance with the present invention.

FIG. 1 depicts a contact lens container which comprises an outer enclosure including a cap 10 and a cannister 12. The cap and cannister respectively are provided with female and male threads which cooperate to facilitate the facile assembly of the cap to the cannister. A flat, annular gasket 14 is disposed within the upper surface of cap 10 for engaging the open end of cannister 12 to provide a liquid-tight seal. A flange 16 on the cannister abuts the edge of cap 10 and acts as a stop. The male threads 18 formed upon the upper end of chamber 12 and the cooperating female threads in cap 10 are advantageously provided with a "square" cross section, and are relatively deep to provide added strength and assure a good engagement between the cap and the cannister. A series of notches 20 are formed in the upper and lowermost peripheries of the cap and the cannister for providing a non-slip surface to be gripped by the user when assembling or disassembling the device.

A pair of basket-like lens receptacles 22 and 24 are hingedly attached to cap 10 and fold apart in the manner depicted. With such an arrangement, cap 10 may be unscrewed from cannister 12 and inverted upon a flat surface such as a table. When the lens baskets are folded outwardly, the lids 26, 28 thereof then lie in a substantially level plane and open upwardly to allow access to the contact lenses without any confusion as to which is the right lens and which is the left. With the lids open, as shown by the position of lid 28 in FIG. 1, the upper surface of the basket is exposed to allow unobstructed access to the concave interior of the basket in which the contact lens is deposited.

An upstanding lip 17 is formed about the upper edge of each basket and is closely surrounded by a mating flange 19 on the basket lid when the lid is closed. This prevents the escape of a contact lens from within the basket should the lid buckle when heat is applied to the container to boil the enclosed solution (as when soft lenses are used) or due to the pressure of a stream of tap water (used to rinse hard lenses).

Still further, with the depicted construction lenses disposed within the baskets can easily be rinsed in water from a tap. The orientation of the baskets and the openings therein allow water to flow over all surfaces of the lenses without obstruction. While the best irrigation of lens surfaces occurs with the baskets in their open or "unfolded" position, it will be recognized that with the baskets in their "folded" or confronting position fluid can also flow therethrough.

From an inspection of the FIGURE, it can be seen that lid 28 is coupled to the body of basket 24 by means of a strap 30. In one successfully tested embodiment the strap, lid and body of the basket were integrally formed. The thickness of strap 30 is reduced near the center thereof to allow it to act as a hinge, constraining lid 28 as it is opened to pivot along an axis which extends transversely through the strap.

Elements such as strap 30 are commonly known as "living hinges" as they provide a pivoted support for a closure, which may be flexed almost indefinitely without failing as a result of fatigue.

In order to secure the lid to the body of the basket latching means are provided. The latching means advantageously take the form of an abutment 32 extending outwardly from the body of the basket, and a flexible arm 34 which extends from the lid portion and is adapted to resiliently engage abutment 32. Arm 34 and abutment 32 are conveniently formed as integral parts of the lid and basket, respectively.

It will now be appreciated that by constructing lens baskets 22 and 24 in a similar manner the baskets can be folded apart, and the lids opened from a common side to obtain access to the interior of the baskets. In particular, with the baskets unfolded and the latches confronting the user the lids open by pivoting upwardly and away from the user. In this position, it is apparent that one basket can be defined as the "left"element and the other as the "right" to allow immediate identification of the lenses therein. If cap 10 is rotated 180° attempts to open the retainers in the manner described will be fruitless since the latching elements will then be disposed at the far side of the apparatus from the user. While it is certainly possible, although slightly awkward, to open the baskets in this position the location of the latches will immediately indicate that the positions of the lens baskets are reversed. In the foregoing manner, the construction of the cap and associated lens retainers serves to prevent a user from mistaking the right lens retainer for the left and vice versa. The fact that the latching, or front, sides of the baskets must face a user for facial manipulation thereof requires that baskets 22 and 24 be disposed to the left and right hand of the user, respectively.

Figure 2:
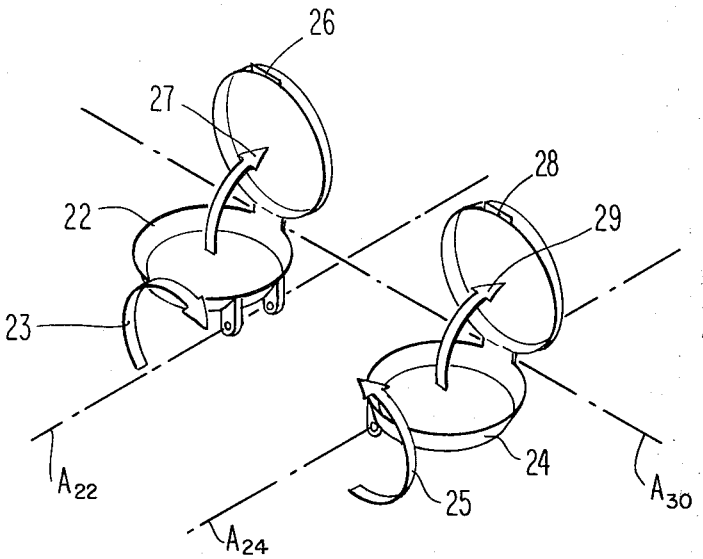
FIG. 2 is an idealized schematic drawing illustrating the relationship of certain elements of the invention.

Turning now to FIG. 2, lens retainers 22, 24 are shown in idealized form. The axes about which lens receptacles 22 and 24 pivot by virtue of their attachment to cap 10 are designated as $A_{22}$ and $A_{24}$, respectively. Arrow 23 indicates the arc described be receptacle 22 in moving from its open or unfolded position (shown in the Figure) to a folded position. Similarly, arrow 25 designates the movement of receptacle 24. It will be seen that axes $A_{22}$ and $A_{24}$ are substantially parallel in order to allow the generally planar lids of the respective lens receptacles to closely confront one another when the receptacles are in their folded position. This minimizes the overall outer dimension of the juxtaposed receptacles so that they may be received by a cannister of minimal size.

An important feature of the instant invention is the relationship of the pivoted lids 26, 28 to the axes $A_{22}$ and $A_{24}$. The points of attachment of lids to their respective bodies lie at the same side of the hinge means about which the receptacles pivot. Accordingly, the receptacles open from the same side so that a user can immediately and unmistakably identify the left-and right-hand baskets.

The axis about which each lid pivots, which may be defined by a living hinge as shown in FIG. 1, advantageously lies along a common line. Since in manufacturing the lens receptacles it is generally desired to make them similar in size, in a preferred embodiment the axes about which lids 26 and 28 pivot are colinear and define the single axis $A_{30}$. However, it is readily apparent that the benefits of the present invention may accrue to receptacles similar in construction and which open from a common side, although the axes about which the lids thereof pivot are not in exact alignment. Such variations in construction are considered to be within the skill of those knowledgeable in the art, and are considered incidental variations of the principles taught herein.

Arrows 27 and 29 illustrate the manner in which lids 26 and 28 open, it being apparent that the axis A about which they pivot is substantially perpendicular to axes $A_{22}$ and $A_{24}$. Accordingly, when the receptacles are unfolded to the position shown a user can easily gain access to the interiors thereof by disengaging the latches and folding the lids back. In this position receptacle 22 will necessarily be disposed to the user's left and receptacle 24 to his right.

If the position of the receptacles is reversed it will be seen that the latches of the receptacle lids are remote from the user, and to open the lids they must be folded toward rather than away from him. This comparatively awkward arrangement is an unmistakable reminder to the user of the improper orientation of the lens receptacles.

Figure 3:
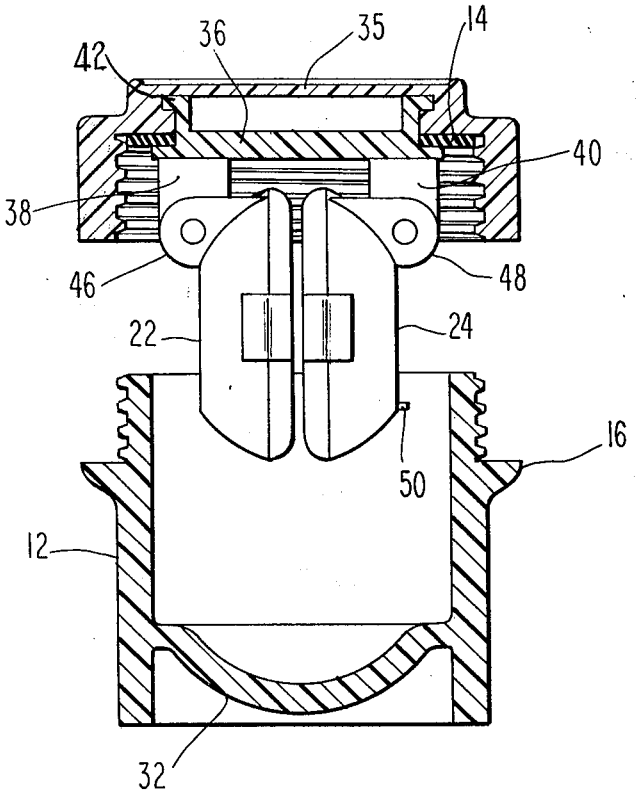
FIG. 3 is a partly sectioned side elevation of the container of FIG. 1.

Turning now to FIG. 3, the detailed construction of the contact lens case of FIG. 1 is shown. In particular, it is seen that cannister 12 comprises a generally cylindrical sidewall, the upper end thereof being threaded and having an annular flange 16 disposed at the lower end of the threaded section. The bottom 32 of the container takes the form of a segment of a sphere, rather than being planar as in most prior art apparatus. The other walls of the cannister extend past the bottom 32 in the manner of the right cylinder to provide a substantially flat lower surface for the cannister. Through the use of the depicted configuration the bottom of the cannister interior is caused to closely conform to the lower ends of the juxtaposed basket 22 and 24 so that the least possible amount of solution is required to submerse the contact lenses.

The advantage of this configuration is attested to by the fact that while competitive soft cases require more than 10 cc's of solution, a case constructed in accordance with the teachings of the present invention required only 5 ½cc's. Further, the vast majority of cases designed for hard contact leanses require more than 8 cc's of solution.

A cap 10 surmounts the assembly and serves both to close cannister 12 and to support the contact lens receptacles therein. The cap terminates at its upper end in a substantially flat surface 35. This allows the cap to be inverted and placed on a table or other working surface for purposes to be explained hereinafter. Disposed within cap 10 is a support 36 for pivotally supporting the basket-like foraminous receptacles 22, 24. The support comprises a generally disc-shaped element 36 which has upstanding therefrom a pair of first hinge elements 38, 40. In one successfully tested embodiment, the first hinge elements comprised upstanding arms having short rod-like axles extending therefrom for engaging mating apertures in second hinge elements 46, 48 which extend from receptacles 22 and 24 respectively. The material from which the lens receptacles are formed, advantageously polypropylene, is sufficiently resilient to allow the second hinge elements to be deformed and snapped over the axle members.

Upstanding from the disc element 36 is a generally annular locking member 42 having radially extending edge portion which are snapped into a mating, annular groove formed within cap 10 as shown. The distance between the inside cap surface and the opposing face of disc member 36 is sufficient to snugly receive the resilient gasket 14, encapturing the gasket between the lens receptacle support and the cap.

Gasket 14 may be formed of any suitable resilient material which is impervious to attack by the various solutions which may be used within the container. In a successfully tested embodiment hospital clear, FDA-approved silicone rubber was used. The gasket lies above the upper end of the threaded portion of the cap 10 and abuts the uppermost, annular edge of the male threaded portion of cannister 12 to provide a fluid-tight seal therewith.

In order to withstand the asepticizing regimen required by soft contact lenses, and additionally to withstand the various solutions which are used for conditioning hard contact lenses, it is necessary that the container be constructed of materials which are highly resistant to chemical attack and to heat. In a successful embodiment the outer enclosure, constituted by cap 10 and cannister 12, was molded from a modified phenylene oxide such as that designated Noryl and manufactured by the Plastics Department of the General Electric Company. It has been found that modified phenylene oxide admirably withstands both chemical erosion from the asepticizing materials utilized, and the high temperatures required for boiling the saline solutions used for conditioning soft contact lenses. The material also exhibits sufficient physical strength to provide a light, strong container structure.

Accordingly, it will be seen that the present invention comprehends an enclosure which requires a minimal amount of solution for conditioning contact lenses, partially due to the compact configuration of the folded juxtaposed lens retaining baskets. In addition, the hinged mounting assembly allows the lens receptacles to be swung from a first, compact configuration to a second position which allows ease in access to the lens-carrying cavities. The lens case assembly is constituted by only two separable portions, one of which encloses the lenses.

FIG. 3 illustrates the compact configuration of the aligned lens receptacles 22 and 24. The planar upper surfaces of lids 26 and 28 are brought into close, confronting relationship while the generally convex body portions of the receptacles face in opposing directions to produce a composite structure having a generally spherical shape. The convex inner surfaces of the body portions of the receptacles are well adapted to receive either hard or soft lenses, and the flattened outer surfaces thereof provide clearance between the body members and the surrounding enclosure wall. The clearance thus provided is important as it allows the liquid within cannister 12 to circulate freely through the formainous receptacles to clean and condition the lenses.

By providing a hinge assembly which comprises first hinge elements 38, 40 coupled to cap 10 and second, cooperating hinge elements 46, 48 the closely aligned receptacles may be withdrawn from cannister 12 and folded apart. With the receptacles unfolded the lids thereof may be opened without interference from the surrounding structure so that the advantages of prior-art separate lens receptacles are retained without an attendant need for a relatively large volume of conditioning fluid in which to immerse the receptacles. Still further, by hinging the receptacle lids at a common side thereof identification of left and right hand lens receptacles is automatic since the retainers assume an invariant relationship with respect to a user despite the folded or unfolded orientation thereof.

Finally, in a successfully tested embodiment, a small protrusion 50 was molded into the body portion of one of the lens receptacles. Protrusion 50 is advantageously located at the lowermost surface of one of the receptacles such that it is invariably touched by the fingers when the receptacles are being folded or unfolded. This provides further, tactile recognition of a predetermined one of the receptacles, and further insures that the user will be able to immediately differentiate left-hand from right-hand lens receptacles.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention .

What is claimed as new and desired to be secured by letters patent of the United States is:

1. A container for retaining and conditioning both hard and soft contact lenses, comprising:

an outer enclosure including first and second members adapted to engage one another in fluid-sealing relationship;

a pair of first hinge elements disposed within one of said members;

a pair of foraminous receptacles for receiving individual contact lenses, each of said receptacles comprising a body portion and a lid portion pivotally attached to said body portin for opening about a first axis, and a second hinge element pivotally engaging one of said first hinge elements for constraining said receptacle to pivot about a second axis generally perpendicular to said first axis, said second axis lying in a plane parallel to the plane of said lid portion;

said first hinge elements being spaced to allow said receptacles to be pivoted into generally parallel relationship so that the lids thereof confront one another.

2. A container as defined in claim 1 wherein the points of attachment of said lid portions to said body portions lie on the same side first hinge elements.

3. A container as defined in claim 2, wherein said lids are constrained to pivot about colinear axes.

4. A container as defined in claim 3, wherein said foraminous receptacles further include latch means disposed oppositely to said points of attachment for releasably coupling said receptacle lids to the bodies thereof.

5. A container as defined in claim 4, wherein the lids of said receptacles are pivotally attached to the bodies thereof by means of a resilient strap.

6. A container as defined in claim 5, wherein the bodies of said receptacles terminate in an annular lip, further including a mating, annular flange extending about the periphery of each lid for receiving said lip.

7. A container as defined in claim 5, further including a tactile projection formed upon the surface of only one of said pair of receptacles to facilitate differentiation of said receptacles.

8. A container as defined in claim 7, wherein said projection is formed on a surface of a body opposite the lid thereof.

9. A container for retaining and conditioning contact lenses, comprising:

an outer enclosure including a generally cylindrical cannister having a threaded flange and a threaded cap for closing said cannister;

a pair of upstanding first hinge elements disposed within said cap;

an annular gasket disposed within said cap for effecting a fluid-tight seal between said cap and said cannister;

a pair of foraminous receptacles for receiving individual contact lenses and including a cupped body portion and generally planar lid portion;

resilient strap means pivotally coupling said lids to ones of said bodies;

each of said bodies having formed thereon a second hinge element which engages one of said first hinge elements to constrain said receptacles to pivot about generally parallel axes extending transversely within said cap, said second hinge members being so oriented that said lid portions pivot about axes substantially perpendicular to the hinge axes.

10. A container as defined in claim 9, wherein the closed end of said cannister is a spherical segment.

11. A container as defined in claim 10, wherein the axes about which said receptacle lids pivot are substantially colinear.

12. A container as defined in claim 11, wherein said cap defines an annular groove and said first hinge elements comprise a disc-like member having means on one side engaging said groove, and a pair of upstanding elements on the opposite side thereof engaging said second hinge elements.

13. A container as defined in claim 12, wherein said gasket is disposed between said cap and said disc.

* * * * *

UNITED STATES PATENT OFFICE

CERTIFICATE OF CORRECTION

Patent No. 3,997,049 Dated December 14, 1976

Inventor(s) Guy J. Sherman

It is certified that error appears in the above-identified patent and that said Letters Patent are hereby corrected as shown below:

Column 4, line 34, "be" should be -- by --.

Column 5, line 2, "A" should be -- $A_{30}$ --;

line 34, after "soft" insert -- lens --.

Column 7, claim 1, line 29, "portin" should be -- portion --.

Signed and Sealed this

Eighth Day of March 1977

[SEAL]

*Attest:*

RUTH C. MASON
*Attesting Officer*

C. MARSHALL DANN
*Commissioner of Patents and Trademarks*